United States Patent [19]

Robillard

[11] 4,220,701

[45] Sep. 2, 1980

[54] METHOD OF PHOTOGRAPHIC TRICHROMATIC PRINTING

[75] Inventor: Jean J. Robillard, Ferney-Voltaire, France

[73] Assignee: Roval S.A., Geneva, Switzerland

[21] Appl. No.: 35,082

[22] Filed: May 1, 1979

Related U.S. Application Data

[63] Continuation of Ser. No. 785,221, Apr. 6, 1977, abandoned.

[30] Foreign Application Priority Data

Apr. 8, 1976 [FR] France ..... 76 10255

[51] Int. Cl.[2] ..... G03C 1/58; G03C 1/52

[52] U.S. Cl. ..... 430/151; 430/154; 430/172; 430/173; 430/174

[58] Field of Search ..... 96/91 R, 49

[56] References Cited

U.S. PATENT DOCUMENTS

| | | | |
|---|---|---|---|
| 3,228,769 | 1/1966 | Workman | 96/91 R |
| 3,360,371 | 12/1967 | Munder et al. | 96/91 R |
| 3,628,954 | 12/1971 | Robillard | 96/91 R |
| 3,676,132 | 7/1972 | Scheler et al. | 96/49 |
| 3,950,171 | 4/1976 | Nihyakumen et al. | 96/49 |

FOREIGN PATENT DOCUMENTS

| | | | |
|---|---|---|---|
| 2254047 | 7/1975 | France | 96/49 |

*Primary Examiner*—Won H. Louie, Jr.

*Attorney, Agent, or Firm*—Robert E. Burns; Emmanuel J. Lobato; Bruce L. Adams

[57] ABSTRACT

A method of photographic trichromatic printing comprises the steps of

A. applying to the substrate a photosensitive emulsion comprising
  (a) a binder;
  (b) three types of grains of semiconductor oxides dispersed in the binder, each adapted to desorb $OH^-$ ions under the action of a primary color radiation; and either
  (c) a diazo system comprising a diazonium salt and three couplers each being adsorbed onto, or dispersed in the immediate vicinity of, one of said three types of grain; or
  (d) a diazo system comprising a coupler and three diazonium salts each being adsorbed onto, or dispersed in the immediate vicinity of, one of said three types of grain;

B. exposure,

C. development by heating; and

D. decomposition of unreacted diazonium salts by exposure to UV light, to fix the image.

An emulsion so produced and substrates carrying such an emulsion are also produced.

11 Claims, 2 Drawing Figures

METHOD OF PHOTOGRAPHIC TRICHROMATIC PRINTING

Figure 1:
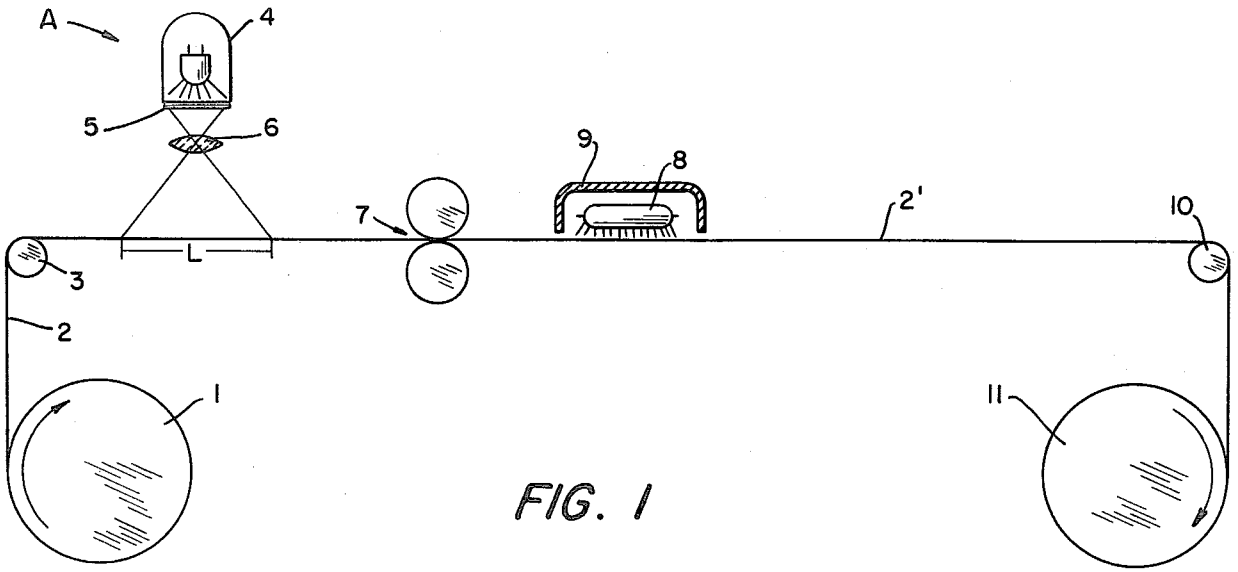

This is a continuation, of application Ser. No. 785,221, filed Apr. 6, 1977, now abandoned

BACKGROUND OF THE INVENTION

The present invention relates in particular to a photographic process for colour printing on various substrates by applying to the substrate a photosensitive emulsion capable of faithfully reproducing a stable polychromatic image from an original in a single operation and without intervention of a liquid carrier during this operation. The invention is especially useful for printing on fabric but can also be employed for printing other substrates such as paper or cardboard.

A number of photographic processes for printing on fabric are already known. The published French Patent Application No. 74 11 761 in the name of Faulquier and Bouchet discloses a process limited to exclusive utilization of a given class of photosensitive compounds, in particular leuco derivatives of vat dyes in the presence of an precursor and a catalyst. This process gives a negative image of the original and comprises four operations in a liquid medium and exposure to ultra-violet radiation. The transparent original must be negative and, if dealing with a trichromatic printing process three colour separation negatives are used, all the operations being carried out three times. Another colour printing process disclosed in the French Patent No. 1 223 330 in the name of Filatures Prouvost and Cie La Lainiere de Roubaix comprises preparing an image of sublimable dyes on a support and transferring the dyes to the support by heating the support in contact with the fabric to be exposed, thereby obtaining a stable and durable image. This process has the disadvantage of requiring the same extent of intermediate support surface as fabric to be exposed. The intermediate support can be prepared in photographic manner by using an electrostatic process in which the "toner" comprises sublimable dyes to be transferred to the fabric, this operation being carried out in three steps corresponding to the three main colours.

On the other hand, the French published Patent Application No. 73 41 591 discloses a trichromatic reproduction process based on photoreduction of certain sensitisable oxides in the three primary colours. This process is applicable in particular to reproduction on paper and can be carried out by a single exposure and development by heating. Although this process could possibly be applied for printing on fabric, it has the serious disadvantage of being too costly for industrial exploitation.

SUMMARY OF THE INVENTION

An object of the present invention is to totally or partly eliminate the disadvantages of the existing processes, in particular the multiplicity of exposures and treatments in the case of polychromatic exposure, operations in liquid phase, utilization of expensive intermediates, high power sources of actinic light, etc.

According to the present invention there is provided a method of trichromatic printing of substrates, characterized in that it comprises:

A. applying to the substrate a photosensitive emulsion comprising:

(a) a binder;

(b) three types of grains of semiconductor oxides dispersed in the binder each adapted to desorb $OH^-$ ions under the action of one of three monochromatic radiations corresponding to the three primary colours (red, blue or green), respectively, these three types of grain being each sensitized respectively to the said radiation by means of an organic chromatic sensitizer adsorbed at the surface of the grains; and either (c) a diazo system comprising a diazonium salt dispersed in the binder and three couplers adapted to react with the diazonium salt to obtain a diazo dye, each of the three couplers being adsorbed at the surface of the grains of a given type, or being disposed in the immediate vicinity thereof, and being adapted to form with the diazonium salt a dye whose colour is complementary (cyan, yellow or magenta) to that corresponding to the radiation to which the said type of grain is sensitized or (c') a diazo system comprising a coupler dispersed in the binder and three diazonium salts adapted to react with the coupler to obtain a diazo dye, each of the three diazonium salts being adsorbed at the surface of the grains of a given type, or being disposed in the immediate vicinity thereof, and being adapted to form with the coupler a dye whose colour (cyan, yellow or magenta) is complementary to that corresponding to the radiation to which the said type of grain is sensitized;

B. Exposure of the substrate carrying the emulsion to an image by means of a transparent colour negative by using a source of white light;

C. development of the image by heating the exposed substrate; and

D. destruction of the diazonium salt or salts which have not reacted by exposure of the substrate to ultra-violet radiation, to fix the image developed during the step C.

The invention also relates to a photosensitive emulsion defined at paragraph A above, as well as to the substrates, in particular the fabrics, carrying such an emulsion.

Optionally, but preferably, the emulsion can further contain (d) at least one complexing agent dispersed in the binder and adapted to increase contrast of the colours thus obtained.

Optionally, but preferably, the emulsion can further contain (e) at least one stabilizer dispersed in the binder and adapted to increase the life of the photosensitive emulsion.

The mechanism of image formation in the method according to the invention is as follows:

Since the grains of oxide are uniformly distributed in the binder, in each "point" of the sensitized emulsion applied to the substrate there are sensitized grains of three types which are respectively responsive to the three primary colours, i.e. red, blue and green. When a grain of emulsion is subjected, upon exposure to an image, to the influence of a radiation of colour corresponding to its sensitization, oxide in the grain desorbs $OH^-$ ions at its surface. On the other hand, grains sensitized to a radiation of a different colour from the radiations affecting the zone where the grains are will not desorb $OH^-$ ions. When later on during the development step the emulsion is heated, desorbed $OH^-$ ions will diffuse in the medium (binder) present in the immediate vicinity of the surface of the grain of oxide on which they have been adsorbed and will considerably increase the pH of the said medium, thereby permitting reaction of the diazonium salt or salts with the coupler or couplers (such a reaction can only take place in a basic medium as is well known) with formation in the immediate vicinity of the said grain of an azoic dye having a colour complementary to that of the radiation to which the grain has been sensitized.

As it will be clearly understood, exposure of the entire surface of the emulsion to an image will produce a colour image, each grain exposed to a radiation corresponding to its sensitization giving the corresponding complementary colour after the development step by heating and the grains exposed to a radiation different from that for which they are sensitized remaining inactive.

Since diffusion of $OH^-$ ions by heating has a very limited effect localized in the immediate vicinity of the grains, the resulting image is very thin.

After development by heating, exposure of the substrate to ultra-violet radiation will destroy any diazonium salt or salts which have not reacted, thereby avoiding any further undesired reaction with the coupler or couplers, and thus any degradation of the image developed during the step (C).

Photosensitive emulsion will be generally applied to substrates in the form of a solution in a suitable solvent, the substrate will then be dried by removing the solvent.

For the exposure to an image, it is possible either to project an image onto the fabric from a colour transparent negative by using in both cases a source of white light (tungsten lamp, flash, etc.). The required exposition duration will vary with the nature of the grains of semiconductor oxides and with the nature and the power of the source of white light, as it will be clearly understood. It is then not possible to give precise indications in this connection. A person skilled in the art, however, knows how to determine experimentally suitable operating conditions in each particular case.

Development by heating will be generally effected at a temperature of the range of from 130° to 180° C.

Binders (a) which can be used in the present invention for dispersing other components of the photosensitive composition are for example polyvinyl alcohol, polyvinyl acetate, polyvinylpyrrolidone, carboxyethylcellulose, methylcellulose, hydroxyethyl-cellulose, etc.

As grains of semiconductor oxides capable of adsorbing at their surface $OH^-$ ions which can be desorbed under the action of radiation in the visible light spectrum after suitable sensitization, one can mention: zinc oxide, titanium oxide, zirconia, tin oxide, rare earth oxides, etc. suitably doped.

The grains employed will generally have sizes ranging from 0.1 to 10 microns. At present, grains of zinc oxide or of titanium dioxide are preferred.

By way of example, doped semiconductor oxides particularly useful in the invention are the following:

| Oxides | Dopant | Oxides | Dopant |
|---|---|---|---|
| $TiO_2/TiO$ | Cu | $ZrO_2$ | La/Cu |
| $TiO_2$ | Ce/Ni | ZnO | Cu |
| $TiO_2$ | La/Ni | ZnO | Ce/Ni |
| $TiO_2$ | Ce/Cu | ZnO | Ni |
| $ZrO_2$ | Ce/Ni | ZnO | La/Ni |

These doped metal oxides may be prepared for example by the following procedure:

Doping is carried out by immersing powder material in a solution of dopant material salts. This operation is followed by heating thereby causing diffusion of the metal ions adsorbed at the surface of the grains in the volume of the latter. The powder is mechanically stirred in a large volume of solution for about half an hour, is then filtered and introduced with a small thickness in a furnace where it is brought to a temperature in the range of from 300° to 500° C. for several hours.

The furnace temperature and the duration of the treatment depend on the nature of the pigment and the diffusibility of the metal ions from the surface to the inside of the grains. The amount of metal adsorbed at the surface of a grain of 10 microns in an 1% solution is of the order of $10^{-4}$ to $10^{-5}$ atoms of metal per atom of the crystal lattice of the pigment. The powder is then separated from the solution by filtration and washed several times with distilled water. The powder is then filtered off again and disposed in a thin layer in boats for heat diffusion. Heat diffusion takes place in two steps: first at a temperature $T_1$ for a time $t_1$, and then at a temperature $T_2$ for a time $t_2$.

At the end of the operation, the furnace is gradually cooled to the ambient temperature. The powder which has become agglomerated in a solid mass is ground and redispersed in ball mills for several hours until the grains pass through a sceen having a suitable number of meshes.

The following Table I gives solutions which can be used with various pigments as well as the temperatures and the duration of the heat treatment.

The characteristics of the doped oxides are given in Table II. The three types of oxide grain will be generally used in equal proportions. The amount of grains dispersed in the binder is not critical and can vary to a large extent. An oxide grains-binder ratio of 5:1 by weight has been found to be generally satisfactory.

Examples of suitable chromatic sensitizers which can be used in the present invention for sensitizing oxide grains are:

for ZnO (a) to red methylene blue, thionine, calcozine violet, (3-ethyl-6-nitrobenzothiazole)-(1'-ethyl-quinoline)-2,4'-dicarbocyanine chloride;

(b) to green 3,3'-diethyl-methylthiocarbocyanine, safranin, pyronine;

(c) to blue 1-methyl-3-ethyl-monomethinethia-2,2'-cyanine iodide, yellow titanium, orange xylenol, phosphine 3R, uranine; and for $TiO_2$ (a) to red 3,3'-diethyl-2,2'-thiadicarbocyanine chloride, 1,1'-diethyl-4,4'-carbocianine chloride, 1,1'-diethyl-4,4'-dicarbocyanine iodide, 1,1'-diethyl-4,4'-tricarbocyanine iodide;

(b) to green bengal rose, phenosafranin, alizarin;

(c) to blue thioflavine chloride, 3,3'-diethyl-thiacyanine-2,2' iodide, (3-ethyl-benzothiazole)-(1'-ethyl-quinoline)-monomethinecyanine-2,4' iodide, (3-ethyl-6-nitrobenzothiazole)-(1'-ethyl-quinoline)-monomethinecyanine-2,4' iodide.

Examples of diazonium salts which can be used in the invention are: 4-morpholino-2,5-diethyl-benzenediazonium fluoroborate, 1-diazo-2,5-dibutoxy-benzoylaminobenzene fluoroborate, 1-diazo-2-carboxy-4-dimethylamino-benzene fluoroborate; 4-dimethylamino benzenediazonium chlorozincate, 4-diethylamino-benzenediazonium chlorozincate, 4-ethyl-hydroxyethylamino-benzene-diazonium chlorozincate, 4-diethylamino-3-chloro benzenediazonium chlorozincate, 4-phenylacetamino-2,5-dietoxy-benzenediazonium chlorozincate, 4-tolyl-mercapto-2,5-dietoxy-benzenediazonium chlorozincate, etc..

Examples of couplers which can be used in the invention are:

for magenta pyrazolone derivatives such as 1-phenyl-3-methyl-pyrazolone-5 as well as resorcylic acid-3,5-ethanolamide.

for yellow acetoacetyl-benzylamide, N,N'-bisacetoacetyl-ethylene-diamine, acetoacetanilide.

for cyan 2,3-dihydroxynaphthalene-6-sulfonic acid sodium salt, 2,7-dihydroxynaphthalene-3,6-disolfonic acid sodium salt, 2,3-dihydroxy-naphthoic acid dimethylaminopropylamide.

Since there exist a large number of coupler-diazonium salt systems adapted to produce an azo dye and to be used in the present invention, the few particular examples described above are to be considered as mere indicative examples. A person skilled in the art can refer to the abundant technical literature concerning the diazo systems to find other systems suitable for use in the present invention. The amounts of sensitizers and couplers (or diazonium salts) adsorbed on the oxide grains are determined by adsorption saturation on each grain. Selection of the amount of each of these components is automatically effected while preparing the grains since the grains are washed after adsorption and only chemisorbed molecules remain after adsorption. The amount of diazonium salt (or of coupler) dispersed in the binder for reaction with the couplers (or diazonium salts) adsorbed on the oxide grains will be at least equal to the required stoichiometric quantity, and preferably exceeding this quantity.

As an optional complexing agent (d) it is possible to use for example zinc chloride, thiourea, etc..

As an optional stabilizer (e) it is possible to use for example citric acid, para-toluene sulfonic acid, etc..

Use of complexing agents and stabilizers is well known in the field of diazo systems and a person skilled in the art can find in the published technical literature further examples of such complexing agents and stabilizers.

Substrates on which the emulsion can be applied are fabrics or cloths, paper and cardboard. The fabrics or cloths which can be used are generally those which accept pigmentary dyes, in particular woolen fabrics; silk fabrics; cellulosic fibre fabrics such as cotton, linen, hemp, and viscose; synthetic fibre fabrics such as polyester and acrylic fabrics; and mixed fibre fabrics such polyester cotton.

The emulsion in the form of a solution in a suitable solvent can be applied to the substrate by any conventional means for applying photosensitive compositions, in particular doctor, air cutter, immersion, etc., followed by drying to remove the solvents. The emulsion is generally applied in an quantity in the range of from 20° to 60° g per $m^2$.

Figure 2:
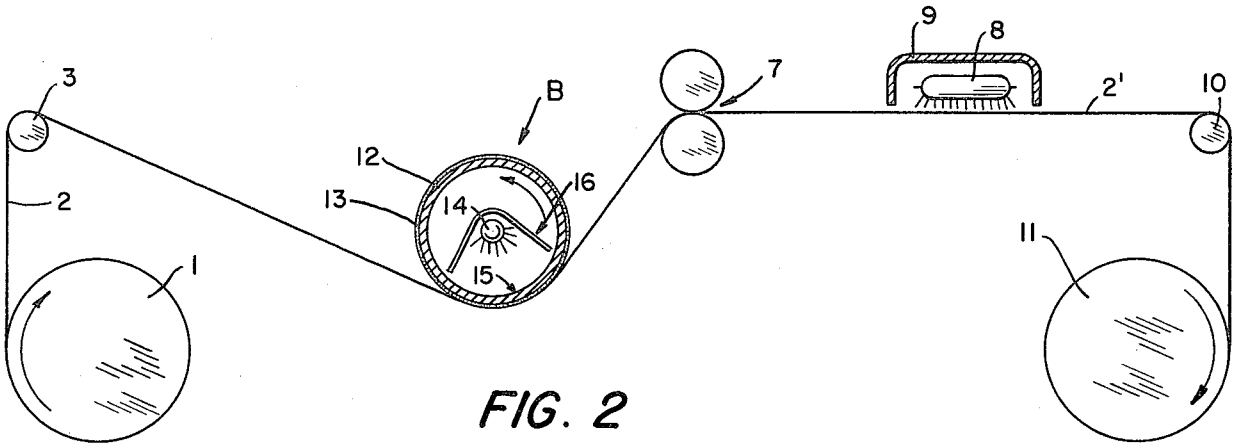

The following is a description with reference to the drawings of two apparatuses for carrying out the steps (B), (C) and (D) of the method according to the invention. In the drawings:

FIG. 1 diagrammatically illustrates a first apparatus in which exposure to an image is effected by projection through a transparent negative original; and FIG. 2 diagrammatically illustrates a second apparatus in which exposure to an image is effected by contact with a transparent negative original.

FIG. 1 shows an apparatus comprising a spool 1 supplying substrate 2 carrying the emulsion in accordance with the invention, a support roller 3, a system for exposure to an image, the system comprising a xenon flash 4, a transparent trichromatic negative original 5 and a lens 6; a pair of heating rollers 7 through which the substrate 2 passes; an ultra-violet lamp the field of which is limited by a screen 9; a support roller 10 and a taking up spool 11 for the substrate 2' carrying a fixed image.

The operation of the apparatus is as follows. The substrate 2 carrying the emulsion is wound off the spool or roll 1 and is caused to pass successively past the exposure system, between the heating rollers, and past the ultra-violet lamp before being wound up on the spool or roll 11. To this end, the substrate 2 is continuously displaced at a speed V of the order of a few meters per minute, whereas the flash 8 the lighting duration of which is very short is and it is lightened at regular time intervals each corresponding to the time required by the substrate to be displaced a distance L equal to the length of the image projected by the exposure system on to the substrate. A series of exposures to an image uninteruptedly between two successive exposures are thus obtained. After exposure the exposed substrate passes through the heating rollers 7 to develop the image and then past the ultraviolet source 8 to fix the developed image. Of course, for a given displacement speed V of the substrate it is necessary to chose a temperature for the rollers 7 and a power for the ultra-violet lamp 8 sufficient to effectively operate development of the image and distruction of the residual diazonium salts which have not reacted.

FIG. 2 shows a variant of the apparatus of FIG. 1 in which exposure to an image is effected by contact instead of by projection. This variant differs from the apparatus of FIG. 1 simply in that the exposure system A is replaced by an exposure system B comprising a rotatable cylinder the outer surface 12 of which is tangent to the substrate 2, is made of a transparent plastics material, and carries a trichromatic transparent negative original 13 the image of which is to be reproduced on the substrate. A source 14 of white light is mounted at the centre of the cylinder and is arranged parallel to the cylinder axis, the source 14 having a tubular shape, being fixed, and lighting only the arc 15 of the cylinder in contact with or close to the substrate 2. This arc can hace a desired length, such of the order of of 10° to 120°. To this end, the lighting action of the tubular source 14 is limited by a fixed screen 16 which is generally in the form of an inverted V the apex of which sorrounds the said source and its limb ends reach the ends of the arc 15.

The operation of this variant is as follows. The rotatable cylinder is rotated in anticlockwise direction at a tip speed equal to the displacement speed of the substrate 2. The source 14 lightes only the arc 15 and the portion of the negative original 13 along this arc. Illumination of a given point of the said portion of the negative original and exposure of the substrate to the colour of that point lasts throughout the interval during which the said point is displaced along the arc 15, bearing in mind that rotation of the cylinder and displacement of the substrate are synchronized. Continuous exposure of the substrate at the various points of the negative original is thus obtained in proportion as the cylinder rotates.

For the rest (development and fixation of the image), the operation of this variant is similar to that of the apparatus of FIG. 1.

The following non-limiting examples are given to illustrate the preparation of trichromatic photosensitive emulsions which can be used in the photographic method of printing substrates, in particular fabrics, according to the invention.

EXAMPLE 1

(a) Preparation of red-sensitized grains 100 g of La/Ni doped and finely divided ZnO are stirred in a solution containing 25 mg of (3-ethyl-6-nitro-benzothiazole)-2,4-(1'-ethyl-quinoline)dicarbocyanine chloride in 500 $cm^3$ of methanol. After an hour the pigment is filtered, washed and dried under vacuum. The pigment is then stirred again in a 0.2% solution of 2,3-dihydroxy-naphthoic acid dimethylaminopropyl amide in alcohol, then filtered, washed and dried.

(b) Preparation of green-sensitized grains 100 g of La/Ni doped and finely divided ZnO are stirred in a solution containing 25 mg of safranine in 500 $cm^3$ of methanol. After an hour the pigment is filtered, washed, and dried under vacuum. The pigment is then stirred again in a 0.2% solution of 1-phenyl-3-methyl-5-pyrazolone in alcohol, filtered, washed and dried.

(c) Preparation of blue-sensitized grains 100 g of La/Ni doped and finely divided ZnO are stirred in a solution containing 25 mg of phosphine 3R in 500 $cm^3$ of methanol. After an hour the pigment is filtered, washed and dried under vacuum. The pigment is then stirred again in a 0.2% solution of acetoacetanilide in alcohol, filtered, washed, and dried.

(d) Preparation of photosensitive emulsion

The following mixture:

| | |
|---|---|
| red-sensitized grains | 50 g |
| green-sensitized grains | 50 g |
| blue-sensitized grains | 50 g |
| $H_2O$ | 100 $cm^3$ |
| 4-diethylamino-benzene diazonium chlorozincate | 1.16 g |
| polyvinylic alcohol | 30 g |
| glycerol | 12 g |
| zinc chloride | 15 g |
| citric acid | 20 g |

is emulsified in a ball mill for 24 hours, and is then applied by impregnation to a fabric.

EXAMPLE 2

(a) Preparation of red-sensitized grains 100 g of Ce/Cu doped and finely divided $TiO_2$ are stirred in a solution containing 25 mg of 1,1'-diethyl-4,4'-carbocyanine chloride in 500 $cm^3$ of methanol. After an hour the pigment is filtered, washed and dried under vacuum. The pigment is then stirred again in a 0.2% solution of 2,3-dihydroxy-naphtoic acid dimethylaminopropylamide in alcohol, filtered, washed and dried.

(b) Preparation of green-sensitized grains 100 g of Ce/Cu doped and finely divided $TiO_2$ are stirred in a solution containing 25 mg of phensoafranine in 500 $cm^3$ of methanol. After an hour the pigment is filtered, washed and dried under vacuum. The pigment is stirred again in a 0.2% solution of 1-phenyl-3-methyl-5-pyrazolone in alcohol, filtered, washed and dried.

(c) Preparation of blue-sensitized grains 100 g of Ce/Cu doped and finaly divided $TiO_2$ are stirred in a solution containing 25 mg of thioflavine chloride in 500 $cm^3$ of methanol. After an hour the pigment is filtered, washed, and dried under vacuum. The pigment is stirred again in a 0.2% solution of N,N'-bisacetoacetylethylenediamine in methyl alcohol, filtered, and dried.

(d) Preparation of photosensitive emulsion

The following mixture:

| | |
|---|---|
| red-sensitized grains | 50 g |
| green-sensitized grains | 50 g |
| blue-sensitized grains | 50 g |
| $H_2O$ | 100 $cm^3$ |
| 4-morpholino-2,5-benzene diazonium fluoroborate | 1.16 g |
| polyvinylpyrrolidone | 30 g |
| Thiourea | 37.5 g |
| zinc chloride | 15 g |
| citric acid | 20 g |

is emulsified in a ball mill for 24 hours and is then applied by impregnation to the fabric.

The photosensitive emulsions of Examples 1 and 2 were applied to polyester fibre fabric by immersing the fabric in the said emulsions, sqeezing the impregnated fabric, and drying. The amount of emulsion applied to the fabric was 53 g per $m^2$.

Images were formed on the impregnated fabric by means of an apparatus similar to those illustrated in FIGS. 1 and 2.

The operating conditions were as follows.

Exposure

Apparatus of FIG. 1 (exposure by projection)

speed of displacement of the substrate: 50 mm/second, i.e. 3 meters/minute;

source of white light formed by a xenon flash having a power of 130 Joules, arranged at a distance of 90 cm from the impregnated fabric, and having a lighting duration of 1/500 seconds;

dimensions of the image projected on to the substrate: 100×100 cm.

Apparatus of FIG. 2 (exposure by contact)

speed of displacement of the substrate and tip speed of the cylinder: 50 mm/second;

cylinder having a diameter of 80 cm and a source of white light constituted by a Philips tube HP 250 with an axially arranged ultra-violet filter, i.e. at about 40 cm from the substrate;

length of the lighted arc: approximately 90°, which corresponds to an exposure duration of a given point of the substrate of about 12 seconds.

Development the temperature of the heating rollers was 150° C. in both cases.

Fixing

In both cases, the source of ultra-violet radiation was constituted by eight Philips tubes TLADX 30 W 05 disposed at a distance of 2 cm from the substrate. The duration of the exposure to ultra-violet radiation was of the order of 20 seconds.

In each case, colour images were obtained on the fabric and were of good quality.

TABLE I

| Pigment | Crystalline form | Doping solution | Concentration (%) | $T_1$ (°C.) | $t_1$ (h) | $T_2$ (°C.) | $t_2$ (h) |
|---|---|---|---|---|---|---|---|
| $TiO_2$ RL16 | rutile | $CuSo_4$ | 1 | 100 | 1 | 420 | 4 |
| $TiO_2$ RL75 | rutile | $Ce(SO_4)_2$ $NiCl_2$ | 0.92-0.78 | 100 | 1 | 400 | 4 |
| $TiO_2$ RL90 | rutile | $Ce(SO_4)_2$ $NiCl_2$ | 0.92-0.78 | 200 | 1 | 380 | 4 |
| $TiO_2$ AT1 | anatase | $LaCl_3$ $NiCl_2$ | 1-0.78 | 200 | 1 | 350 | 6 |
| $TiO_2$ AT4 | anatase | $Ce(SO_4)_2$ $CuSO_4$ | 0.92-1 | 200 | 1 | 320 | 6 |
| ZnO Neige | Zincite | $CuSO_4$ | 1 | 100 | 1 | 475 | 5 |
| ZnO Radox15 | Zincite | $Ce(SO_4)_2$ $NiCl_2$ | 0.92-0.78 | 100 | 1 | 450 | 5 |
| ZnO Radox72 | Zincite | $NlCl_2$ | 0.78 | 100 | 1 | 450 | 5 |
| ZnO Photox801 | Zincite | $LaCl_3$ $NiCl_2$ | 1-0.78 | 100 | 1 | 450 | 5 |
| $ZrO_2$ | Daddeleyite | $Ce(SO_4)_2$ $NiCl_2$ | 0.92-0.78 | 200 | 1 | 500 | 4 |
| $ZrO_2$ | Daddeleyite | $LaCl_3$ $CuSO_4$ | 1-1 | 200 | 1 | 500 | 4 |

TABLE II

| Pigment | Type | Density | Purity (%) | Impurity | Particle sizes (microns) | pH | Origin (A) |
|---|---|---|---|---|---|---|---|
| Anatase | AT1 | 3.8 | 98.0 | Al, Si | 0.03 | 6.8 | TM |
| Anatase | AT4 | 3.7 | 96.0 | Al, Si | 0.3 | 6.8 | TM |
| Rutile | RL16 | 4.0 | 90.0 | Al, Si | 0.35 | 8.8<br>7.8 | TM |
| Rutile | RL75 | 3.8 | 86.0 | Al, Si | 0.35 | 6.8<br>8.0 | TM |
| Rutile | RL90 | 4.0 | 96.0 | Zn, Al, Si | 0.10 | 8.0 | TM |
| Zinc oxide | Neige C | 5.67 | 99.7 | Pb, Cd, S | 0.27 | 7.0 | VM |
| Zinc oxide | USP 12 | 5.60 | 99.8 | PbO, $As_2O_3$ | 0.30 | 7.0 | NJZ |
| Zinc oxide | Photox 801 | 5.65 | 99.8 | PbO, CdO | 0.37 | 7.0 | NJZ |

(A)
TM: Fabriques de Produits chimiques de Thahn et Mulhouse
VN: Societe do la Vieille Montagne
NJZ: New Jersey Zinc Company

I claim:

1. A method of trichromatic printing substrates, which comprises:

A. applying to the substrate a photosensitive emulsion comprising:

(a) a binder;

(b) three types of grains of semiconductor oxides dispersed in the binder each adapted to desorb $OH^-$ ions under the action of one of three monochromatic radiations corresponding to the three primary colours (red, blue or green), respectively, these three types of grain being each sensitized respectively to the said radiation by means of an organic chromatic sensitizer adsorbed at the surface of the grains; and either (c) a diazo system comprising a diazonium salt dispersed in the binder and three couplers adapted to react with the diazonium salt to obtain a diazo dye, each of the three couplers being adsorbed at the surface of the grains of a given type, or being disposed in the immediate vicinity thereof, and being adapted to form with the diazonium salt a dye whose colour is complementary (cyan, yellow or magenta) to that corresponding to the radiation to which the said type of grain is sensitized; or (c') a diazo system comprising a coupler dispersed in the binder and three diazonium salts adapted to react with the coupler to obtain a diazo dye, each of the three diazonium salts being adsorbed at the surface of the grains of a given type, or being disposed in the immediate vicinity thereof, and being adapted to form with the coupler a dye whose colour (cyan, yellow or magenta) is complementary to that corresponding to the radiation to which the said type of grain is sensitized;

B. exposing the substrate carrying the emulsion to image by means of a transparent colour negative by using a source of white light whereby grains of said semiconductor oxide which are subjected to radiation of a color corresponding to its sensitization desorb $OH^-$ ions, C. developing the image by heating the exposed substrate whereby said desorbed $OH^-$ are diffused in the immediate vicinity of said oxide causing an increase in the pH and thereby permitting reaction of said diazonium salt with said coupler and D. destroying the diazonium salt or salts which have not reacted by exposure of the substrate to ultra-violet radiation to fix the image developed during the step C.

2. A method as claimed in claim 1, where the emulsion further comprises (d) at least one complexing agent dispersed in the binder and adapted to increase contrast of the colours thus obtained.

3. A method as claimed in claim 1, wherein the emulsion further comprises (e) at least one stabilizer dispersed in the binder and adapted to increase the life of the photosensitive emulsion.

4. A photosensitive emulsion wherein comprises:

(a) a binder;

(b) three types of semiconductor oxide grains dispersed in the binder each adapted to desorb $OH^-$ ions under the action of one of three monochromatic radiations corresponding to the three primary colours (red, blue or green), respectively, these three types of grain being each sensitized respectively to the said radiation by means of an organic chromatic sensitizer adsorbed in the grains; and either (c) a diazo system comprising a diazonium salt dispersed in the binder and three couplers adapted to react with the diazonium salt to obtain a diazo dye, each of the three couplers being adsorbed at the surface of the grains of a given type, or being disposed in the immediate vicinity thereof, and being adapted to form with the diazonium salt a dye whose colour is complimentary (cyan, yellow or magenta) to that corresponding to the radiation to which the said type of grain is sensitized; or (c') a diazo system comprising a coupler dispersed in the binder and three diazonium salts adapted to react with the coupler to obtain a diazo dye, each of the three diazonium salts being adsorbed at the surface of the grains of a given type, or being disposed in the immediate vicinity thereof, and being adapted to form with the coupler a dye whose colour (cyan, yellow or magenta) is complementary to that corresponding to the radiation to which the said type of grain is sensitized.

5. An emulsion as claimed in claim 4, which in comprises (d) at least one complexing agent dispersed in the binder and adapted to increase contrast of the colour thus obtained.

6. An emulsion as claimed in claim 4 which further comprises (e) at least one stabilizer dispersed in the binder and adapted to increase the life of the photosensitive emulsion.

7. A substrate which carries an emulsion in accordance with claim 4.

8. A substrate which carries an emulsion in accordance with any of the claims 4 to 6 is a fabric.

9. A photosensitive emulsion according to claim 4 in which said grains are selected from the group consisting of zinc oxide, titanium oxide, zirconia, tin oxide and rare earth oxide.

10. A photosensitive emulsion according to claim 4 in which said grains are selected from the group consisting of zirconium oxide, zinc oxide and titanium oxide.

11. A photosensitive emulsion according to claim 4, in which said grains are doped semiconductor oxides having a particle size ranging from about 0.1 to 10 microns.

* * * * *